US007287931B2

(12) United States Patent
Anibaldi et al.

(10) Patent No.: US 7,287,931 B2
(45) Date of Patent: Oct. 30, 2007

(54) EXTENDABLE PAVING SCREED

(75) Inventors: Simone Anibaldi, Ferrara (IT); Terrence J. Nowak, Champlin, MN (US); Francesco Pisano, Bologna (IT); Federico B. Rio, Bologna (IT)

(73) Assignee: Bitelli SpA (IT)

( * ) Notice: Subject to any disclaimer, the term of this patent is extended or adjusted under 35 U.S.C. 154(b) by 207 days.

(21) Appl. No.: 11/058,830

(22) Filed: Feb. 16, 2005

(65) Prior Publication Data

US 2005/0249554 A1 Nov. 10, 2005

(30) Foreign Application Priority Data

May 10, 2004 (EP) ..... 04011028

(51) Int. Cl.
*E01C 19/00* (2006.01)

(52) U.S. Cl. ..... 404/104; 404/101; 404/118

(58) Field of Classification Search ..... 404/118, 404/104, 96, 101
See application file for complete search history.

(56) References Cited

U.S. PATENT DOCUMENTS 4,969,773 A 11/1990 Heims
4,986,695 A 1/1991 Heims
4,991,995 A 2/1991 Heims
5,725,325 A 3/1998 Schleiter et al.
6,203,243 B1 3/2001 Birtchet

FOREIGN PATENT DOCUMENTS

DE 4229464 A 3/1994
EP 0 493 889 B1 7/1992
EP 0 686 729 B1 12/1995
EP 0879918 B1 4/1998
EP 0967329 A 12/1999

*Primary Examiner*—Raymond Addie
(74) *Attorney, Agent, or Firm*—Finnegan, Henderson, Farabow, Garrett & Dunner

(57) ABSTRACT

A screed assembly for a paving machine includes a main screed portion and an extension screed portion longitudinally extendable from the main screed portion. The extension screed portion includes a variable length coupling portion arranged in a manner sufficient to permit modifying the overall length of the extension screed portion such that the screed assembly may be extended to a maximum overall width that is twice that of the minimum retracted width.

17 Claims, 9 Drawing Sheets

EXTENDABLE PAVING SCREED

This application claims priority to European Patent Application Serial No. 04011028.0, filed on May 10,2005.

TECHNICAL FIELD

The present invention relates to paving machines having screed assemblies and, more particularly, to screed assemblies having linearly extendable portions.

BACKGROUND

Paving machines are used for depositing, spreading, compacting, and smoothing paving material on a roadbed in such a manner that a uniform and drivable surface is produced. Screed assemblies are used to smooth and compact the paving material. The screed assembly is typically drawn behind the paving machine and is adjustable to establish both the thickness of the deposited layer of paving material and the width of the area over which the material is spread.

Modern screed assemblies typically include one or more base or fixed portions and one or more extendable portions that may be adjusted relative to the fixed portions to control the working width of the screed assembly. A common arrangement uses two base portions arranged end to end such that they may be independently tipped from horizontal to permit laying a paved mat having a desired cross-section, for example, a center crown. Each base portion commonly includes an extendable portion that may be moved inwardly to minimize the width of the screed assembly during transport and may be extended outwardly up to a maximum extension length to increase the paving capacity of the machine.

It is desirable to provide a screed assembly in which the fully extended screed width is at least twice the fully retracted width. However, achieving a full doubling of screed width is difficult because of necessary structural overlaps in portions of the fixed and extendable screed elements. Because of this, the fully extended screed width is typically several centimeters less than double the fully retracted width.

One example of a screed assembly adapted to address this problem is found in U.S. Pat. No. 4,986,695, which describes an apparatus that uses a number of telescopic rods to permit elongation of the base screed portion in the extended position. However, this is a complex mechanical arrangement involving multiple components moving relative one to the other, and may not be suitable for screed assemblies where a high degree of rigidity is required and where simplicity of operation is necessary for trouble-free operation.

The present invention is directed to providing a double extending screed that overcomes one or more of the problems set forth above.

SUMMARY OF THE INVENTION

In one aspect of the present invention, a screed assembly for a paving machine includes a main screed portion having a fixed length frame and an extension screed portion having a variable length frame defined by an inner end wall and an outer end wall and having an intermediate wall. The inner end wall and intermediate walls are axially movable one relative to the other. A coupling portion is located between the inner and outer end walls and has a first coupling member connected to the inner end wall and extending through the intermediate wall toward the outer end wall and a second coupling member connected to the outer end wall and extending to the intermediate wall. The coupling members are coaxially slidable one within the other. An actuator is adapted to controllably move the extension screed portion longitudinally axially relative to the main screed portion between a fully retracted position at which the intermediate wall is urged toward the inner end wall and a fully extended position at which the intermediate wall is urged away from the inner end wall.

In a second aspect of the present invention, a method is disclosed for providing an extendable screed assembly for a paving machine. The screed assembly has a main screed portion having a fixed length frame and an extension screed portion extendable from the main screed portion. The extension screed portion has a variable length frame defined by an inner end wall and an outer end wall and has an intermediate wall. The inner end wall and intermediate walls are axially movable one relative to the other. A coupling portion is located between the inner and outer end walls and has a first coupling member connected to the inner end wall and extending through the intermediate wall to the outer end wall and a second coupling member connected to the outer end wall and extending to the intermediate wall. The first and second coupling members are coaxially slidable one within the other. An actuator is adapted to controllably move the extension screed portion longitudinally axially relative to the main screed portion between a fully retracted and a fully extended position. The method includes the steps of moving the variable length portion intermediate wall toward the inner end wall in response to the actuator moving the extension screed portion to the fully retracted position and moving the variable length portion intermediate wall away from the inner end wall in response to the actuator moving the extension screed portion to the fully extended position.

DETAILED DESCRIPTION

Figure 1:
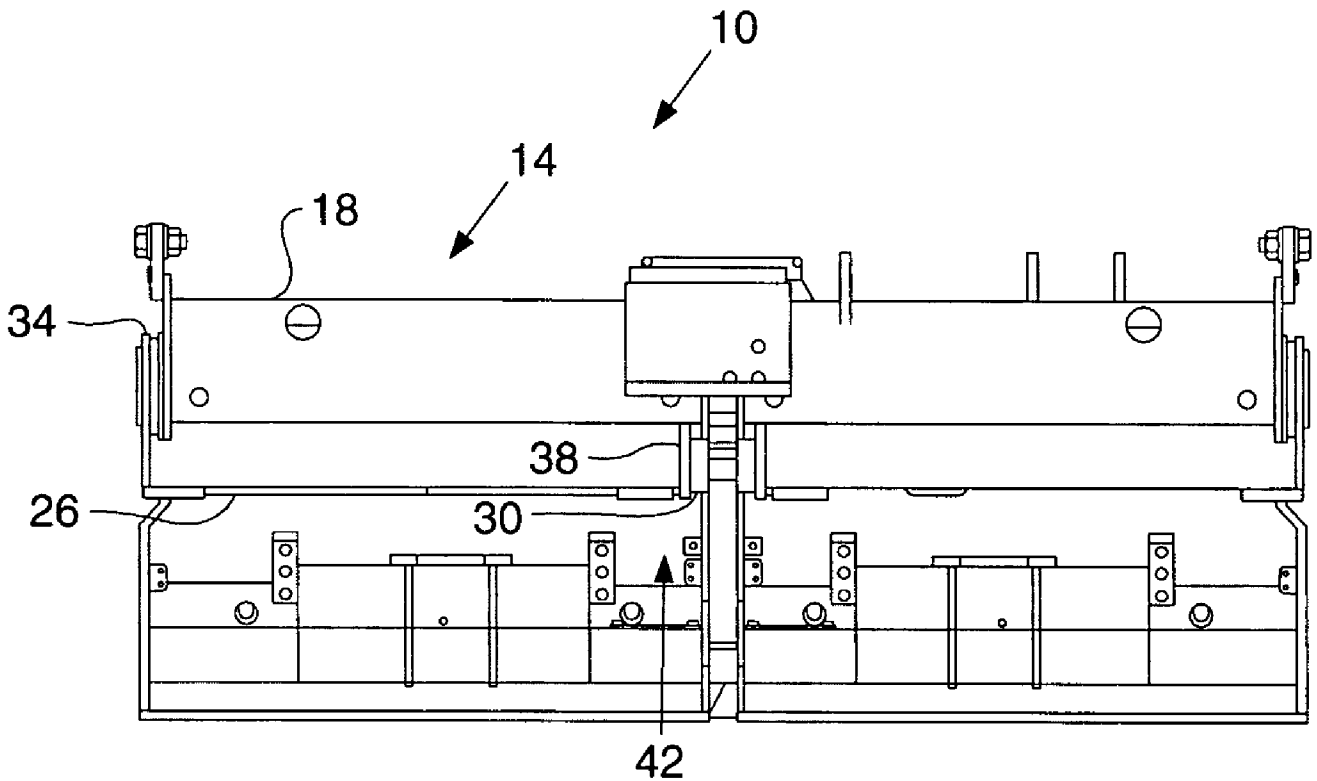
FIG. 1 is a front diagrammatic view of a screed assembly having retracted extension portions.
Figure 2:
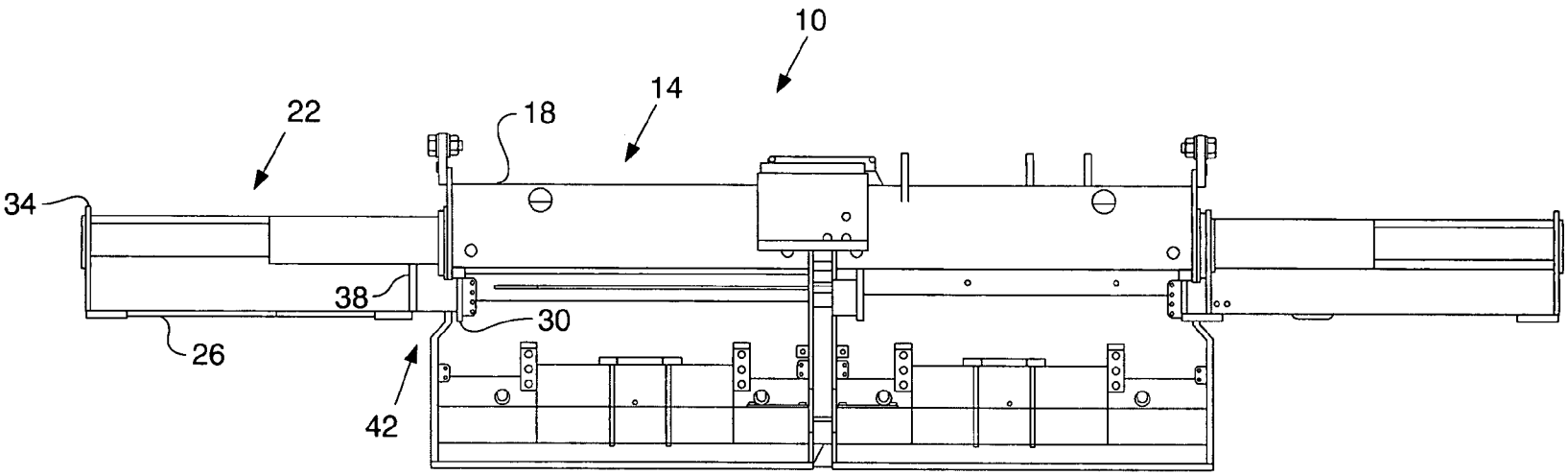
FIG. 2 is a front diagrammatic view of the screed assembly of FIG. 1 having extended extension portions.
Figure 3:
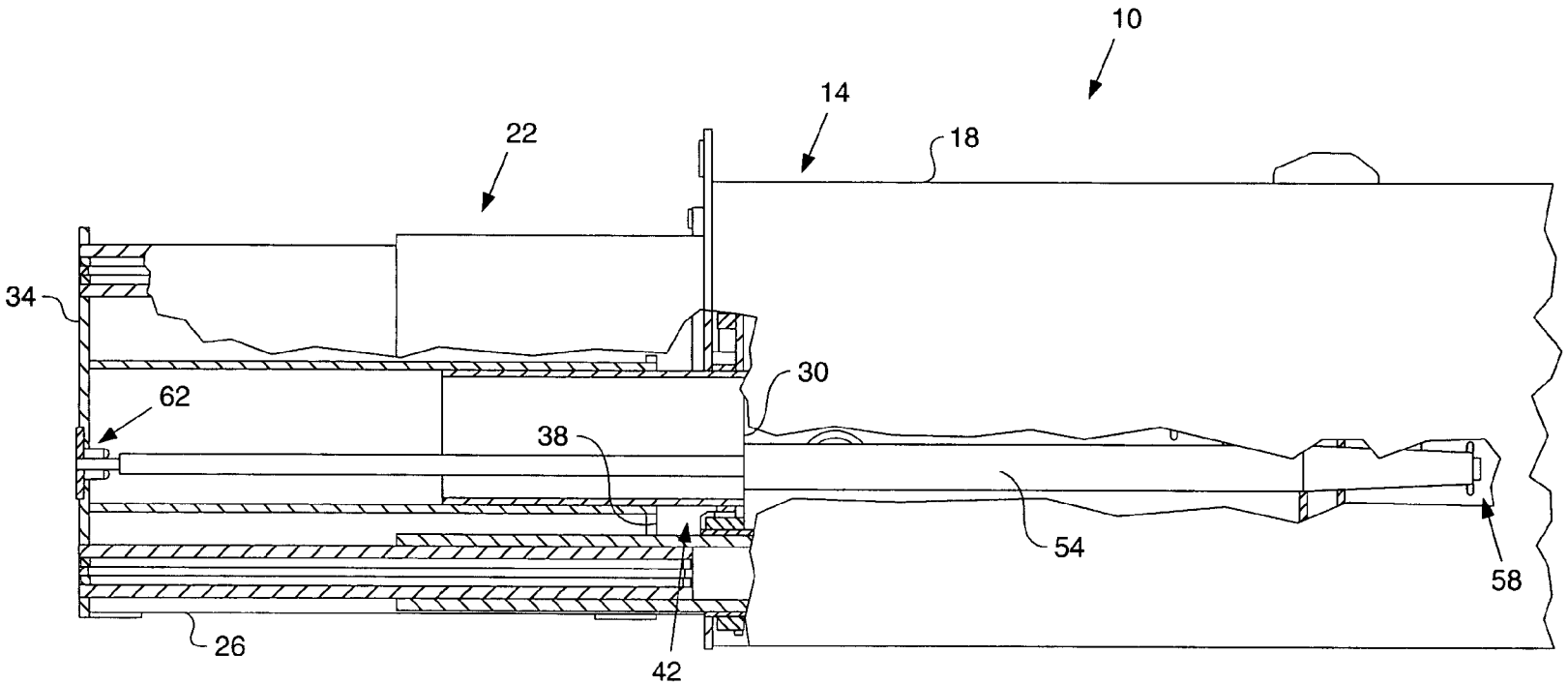
FIG. 3 is a top diagrammatic view of a portion of the screed assembly of FIG. 2.

Referring generally to the figures, and in particular to FIGS. 1-3, a paving machine (not shown) has a screed assembly 10. The screed assembly 10 may be connected to the paving machine via drawbars or in other conventional manners known in the art. The screed assembly 10 includes an elongate main screed portion 14 having a fixed length frame 18, and an elongate extension screed portion 22 longitudinally axially extendable from the main screed portion 14. The extension screed portion 22 has a variable length frame 26 partially defined by an inner end wall 30 and an outer end wall 34 and including an intermediate wall 38. The inner end wall 30 and the intermediate wall 38 are axially movable one relative to the other.

A coupling portion 42 is located between the variable length frame inner and outer end walls 30, 34. The coupling portion 42 has a first coupling member 46 connected to the inner end wall 30 and extending through the intermediate wall 38 toward the outer end wall 34, and a second coupling member 50 connected to the outer end wall 34 and extending to the intermediate wall 38. The first and second coupling members 46, 50 are coaxially slidable one within the other, and in a preferred embodiment cooperate to form an elongated cavity. Also in a preferred embodiment, the first and second coupling members 46, 50 are coaxially positioned cylinders 48, 52, one slidable within the other. However, the coupling members 46, 50 could be constructed of other configurations suitable for coaxial interaction such as triangular, rectangular, or other curved or polygonal structures.

An actuator 54 has a first end portion 58 connected to the main screed portion frame 18 and a second end portion 62 connected to the extension screed portion variable length frame outer end wall 34. In a preferred embodiment, the actuator 54 may be a linear operator such as a hydraulic cylinder, and may be at least partially located within the elongate cavity formed by the cooperation of the first and second coupling members 46, 50. The actuator 54 is adapted to controllably move the extension screed portion variable length frame 26 longitudinally axially relative to the main screed portion fixed length frame 18 between a fully retracted position at which the variable length portion intermediate wall 38 is urged toward the inner end wall 30 and a fully extended position at which the variable length portion intermediate wall 38 is urged away from the inner end wall 30.

Figure 4:
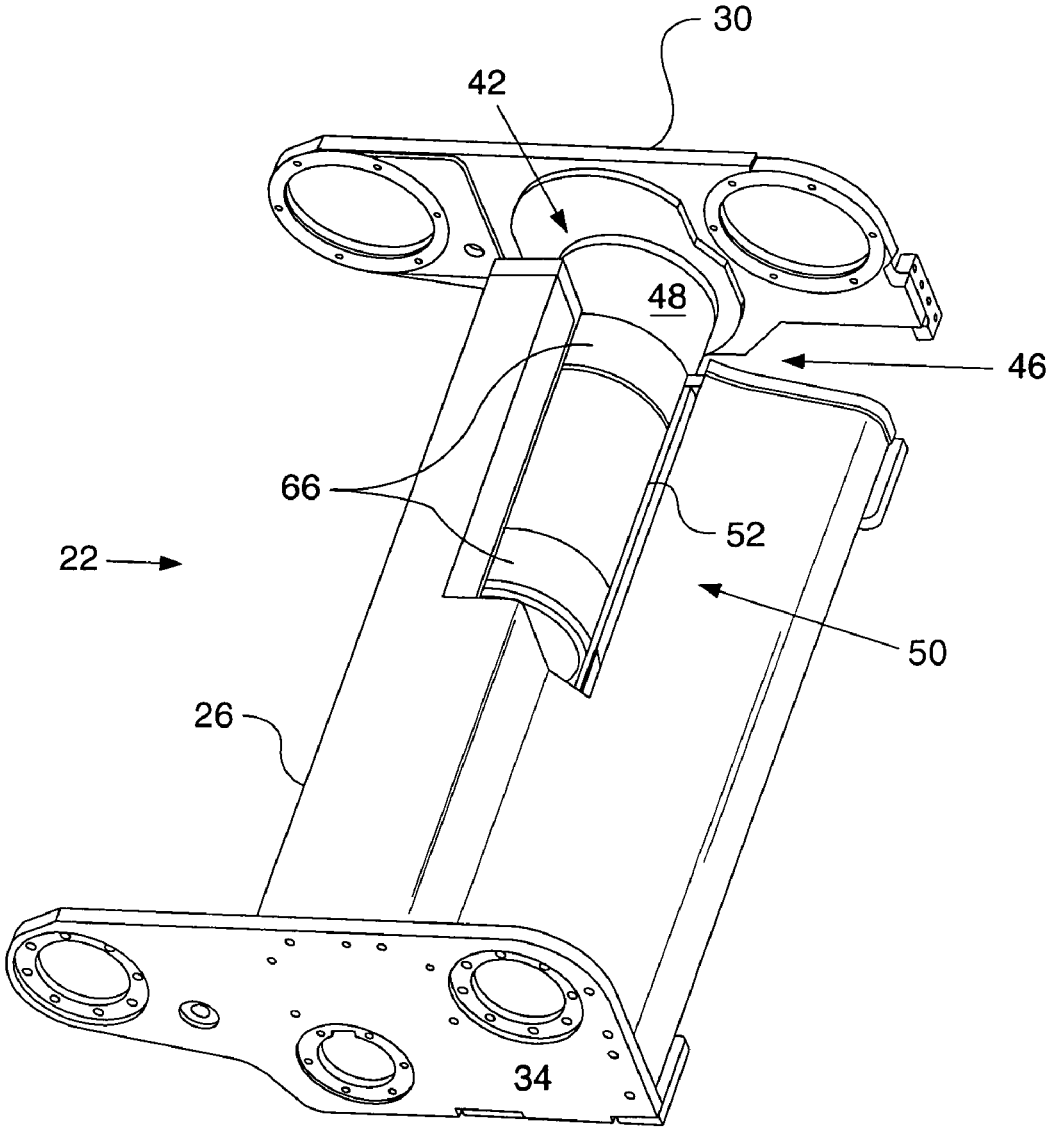
FIG. 4 is a partially cutaway view of an embodiment of a portion of a screed assembly according to the present invention.

As best seen in FIG. 4, one of the coupling members 46, 50 preferably includes at least one bushing 66 extending circumferentially over a linear portion of the coupling member 46, 50. The bushing 66 is adapted to provide a clearance fit between the coaxially slidable coupling members 46, 50. In the illustrated embodiment, the bushing 66 is located on the inner of the coaxial coupling members 46, 50, and acts to permit sliding relative motion between the coupling members 46, 50 while eliminating excessive play or looseness in the sliding arrangement. The illustrated embodiment depicts the use of two such bushings 66, but the exact number and location of the bushings 66 is a matter of design choice.

Figure 5:
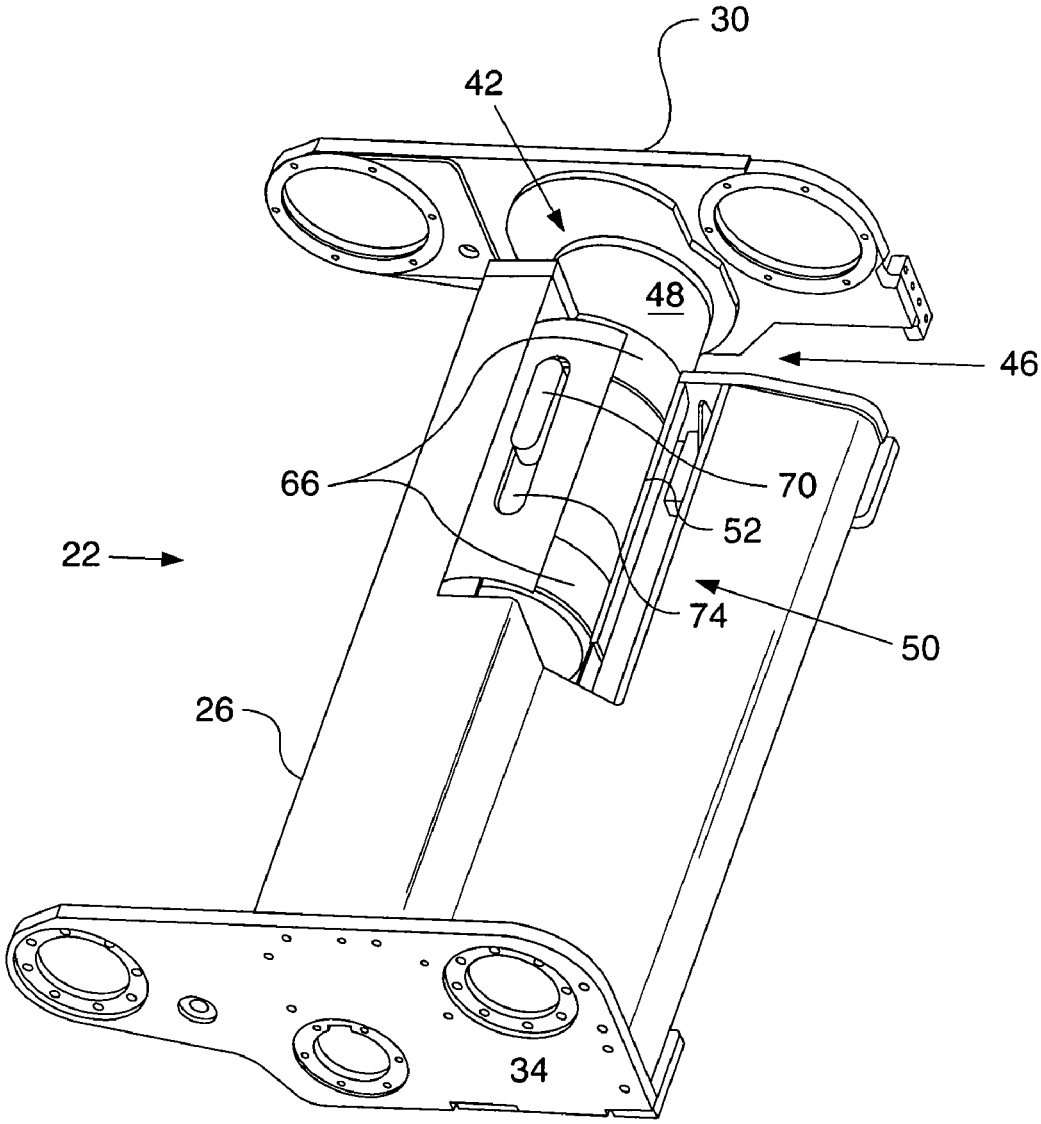
FIG. 5 is a partially cutaway view of a second embodiment of a portion of a screed assembly according to the present invention.
Figure 6:
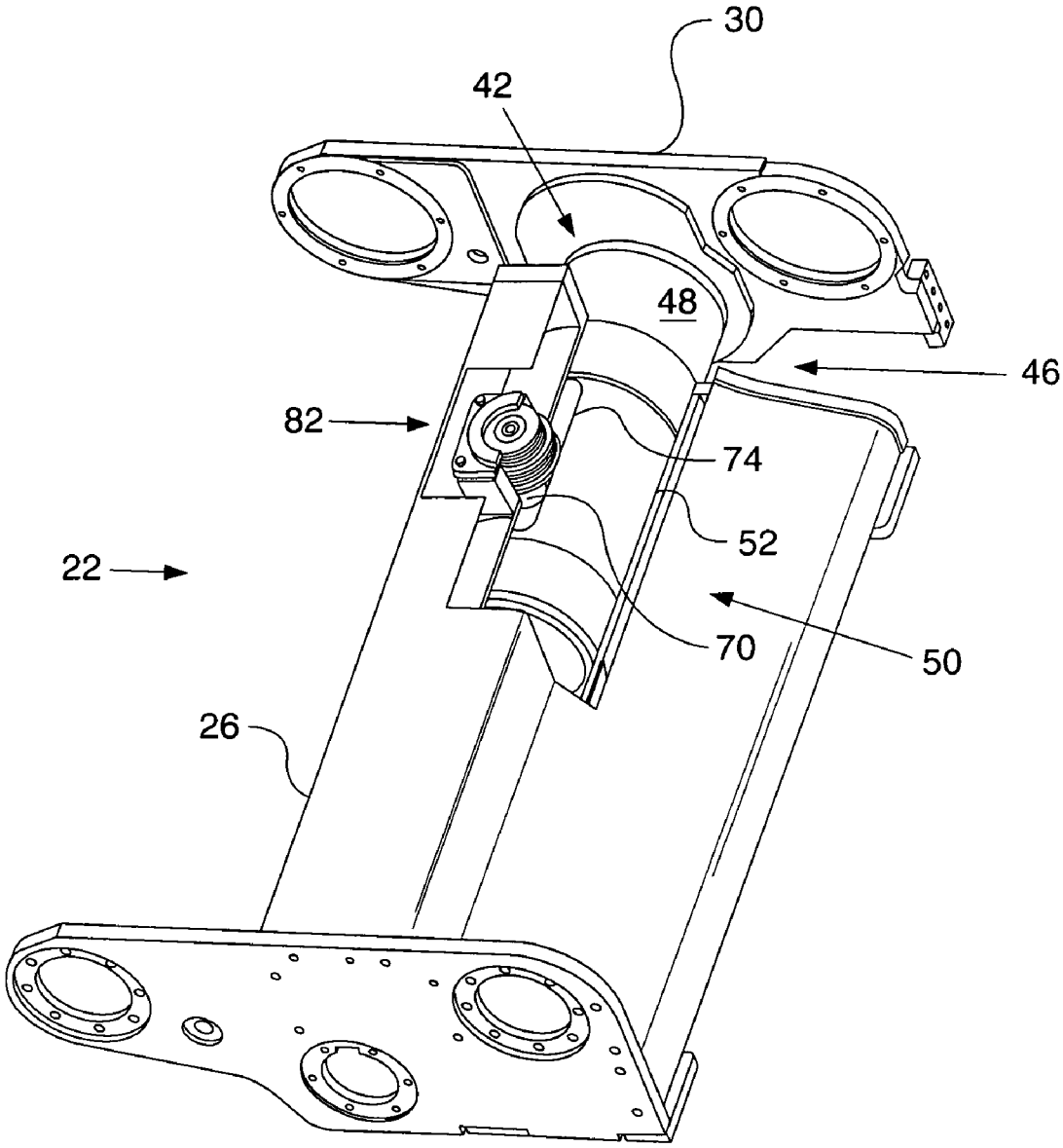
FIG. 6 is a partially cutaway view of a third embodiment of a portion of a screed assembly according to the present invention.
Figure 7:
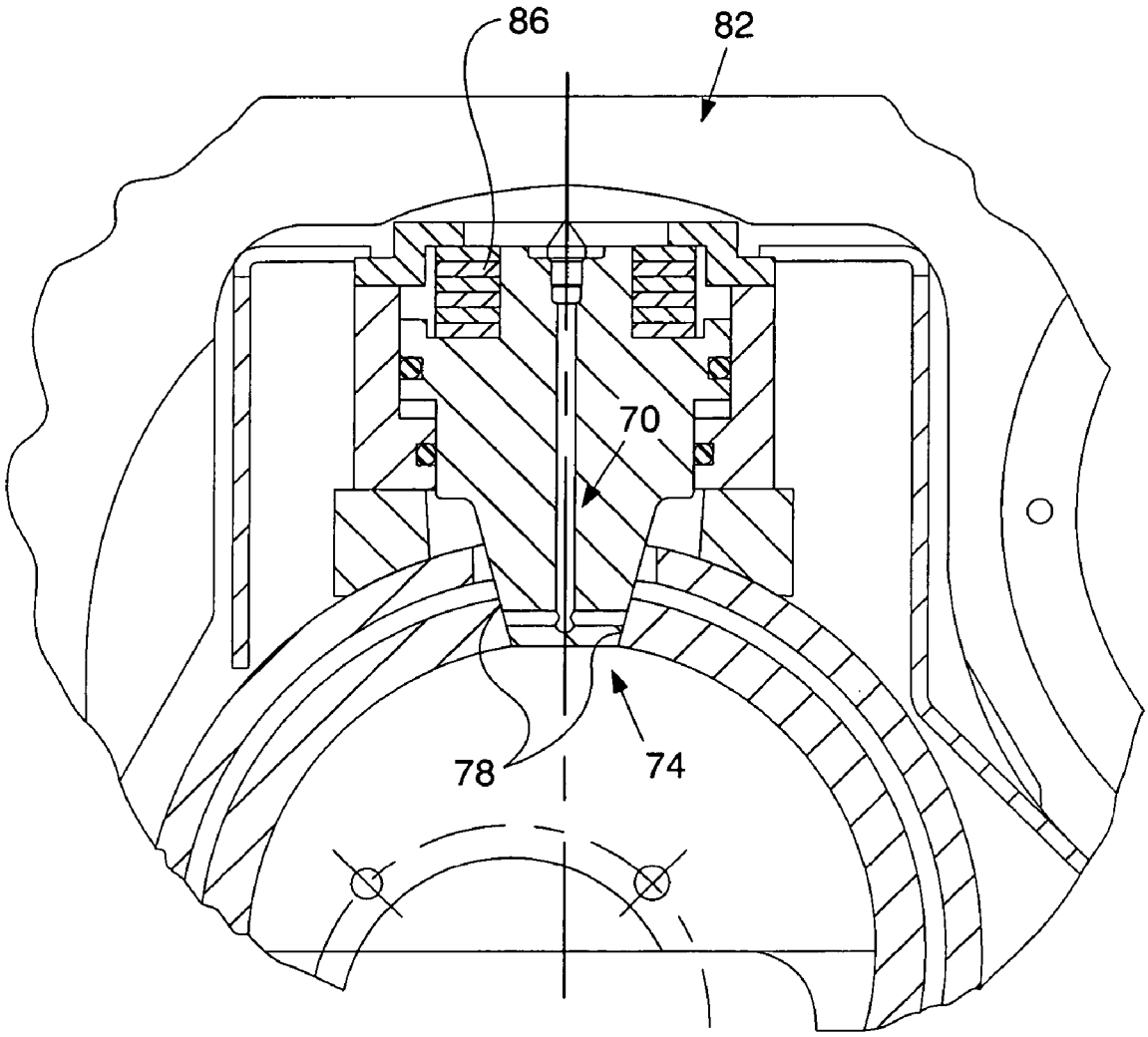
FIG. 7 is an enlarged cross-sectional view of a portion of the screed assembly of FIG. 6.

In some applications of embodiments of the present invention, it may be desirable to increase the rigidity of the screed assembly 10 by preventing relative rotational movement between the coupling members 46, 50 while permitting relative linear movement. FIGS. 5-7 illustrate various embodiments of a screed assembly 10 wherein the coupling portion 42 includes a key 70 and keyway 74 respectively positioned to permit relative linear movement between the coupling members 46, 50 and to inhibit relative rotational movement between the coupling members 46, 50. In a preferred embodiment of such a construction, the key 70 and keyway 74 each have at least one tapered or mating wall 78. In the illustration of FIG. 7, the key 70 and keyway 74 are shown to each have respective corresponding tapered walls 78 along both mating surfaces.

To further enhance the rigidity of the screed assembly 10, the key 70 may be driven under power into or released under power from the keyway 74. This may be done in any of a number of conventional manners, including using a hydraulic or electrical actuator to move the key 70 relative to the keyway 74. The selected actuator may be bidirectional, or may be unidirectional with a resilient member such as a spring biasing the key in the non-powered direction. In the preferred embodiment illustrated in FIGS. 6 and 7, the key 70 is biased by an actuator 82 having a spring 86 arranged to maintain the key 70 engaged with the keyway 74. This preferred embodiment enables relative linear motion between the coupling members 46, 50 while substantially eliminating rotational movement.

Figure 8:
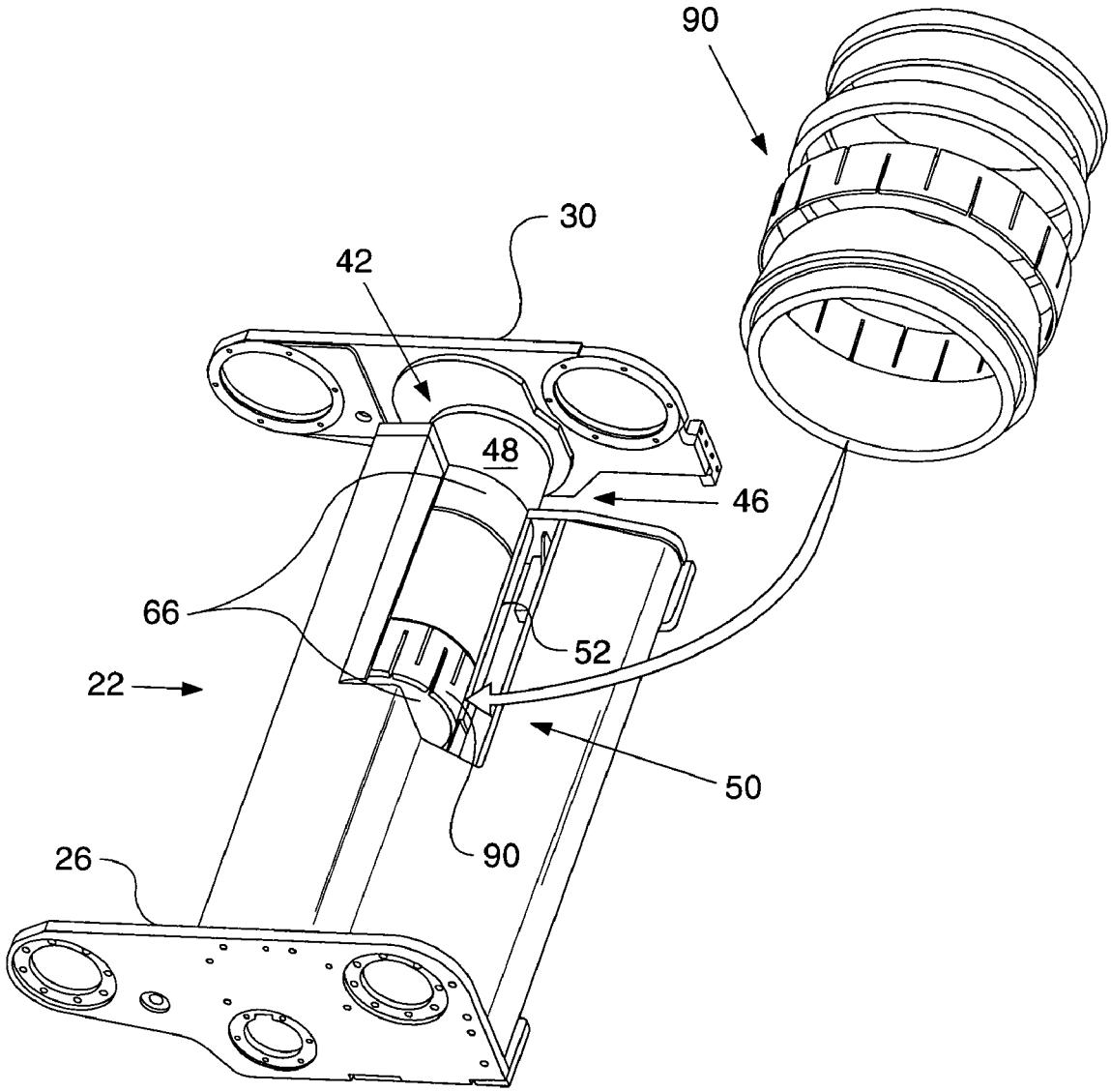
FIG. 8 is a partially cutaway view of a fourth embodiment of a portion of a screed assembly according to the present invention.

In yet another embodiment of the present invention, as shown in FIG. 8, one of the coaxial cylinders employed as a coupling member 46, 50 may include a chuck 90 adapted to controllably clamp the other of the coaxial cylinders in a manner sufficient to prevent relative movement between the cylinders. With this arrangement, all movement between the first and second coupling members 46, 50 is prevented when the chuck 90 is clamped. The chuck 90 may be operated in any conventional manner, for example, using a hydraulic or electrical actuator.

Figure 9:
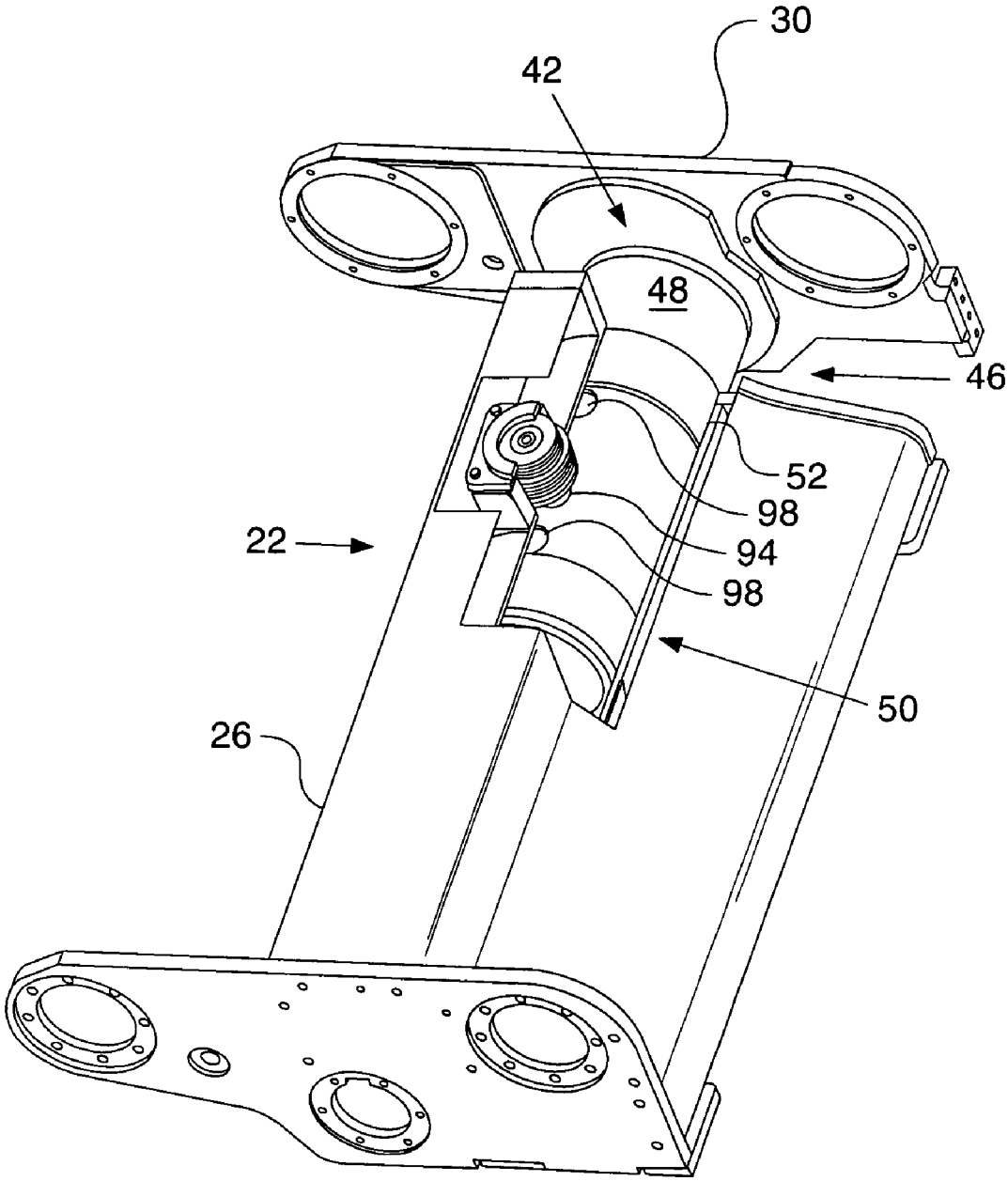
FIG. 9 is a partially cutaway view of a fifth embodiment of a portion of a screed assembly according to the present invention.

In yet another embodiment of the present invention, as shown in FIG. 9, one of the first and second coupling members 46, 50 may include at least one protrusion 94 and the other of the first and second coupling members 46, 50 may include at least one respective receptacle 98 positioned to receive the protrusion 94. Again, this arrangement provides a positive lock against all relative movement between the first and second coupling members 46, 50. However, with this arrangement the length of the coupling portion 42 cannot be varied beyond the preselected relative positions of the protrusion 94 and receptacle 98.

For brevity and convenience of drafting, the foregoing description details the structure and operation of one extension screed portion 22 cooperating with a respective main screed portion 14. However, a typical screed assembly 10, as depicted in FIGS. 1 and 2, includes both left and right hand screed portions which are essentially mirror images of one another, and this description and the appended claims apply in like manner to both of such left and right hand screed portions.

INDUSTRIAL APPLICABILITY

In a typical application of a screed assembly 10 for a paving machine, it is desirable to adjust the working width of the screed assembly 10. During transport of the screed assembly 10 the outer extendable screed portions 22 may be retracted using the actuators 54 such that the variable length portion intermediate walls 38 are moved toward the inner end walls 30. In this position, the overall width of the screed assembly 10 is minimized. When preparing the screed assembly 10 for operation, the extendable screed portions 22 are extended using the actuators 54 to provide a desired total paving width.

The apparatus described above including the coupling portions 42 enables such extended width to accommodate structural overlaps such that the screed assembly 10 may be extended to fully double the retracted width. This occurs when the variable length portion intermediate wall 38 is moved away from the inner end wall 30 in response to the actuator 54 moving the extension screed portion variable length frame 26 longitudinally axially relative to the main screed portion fixed length frame 18 to the fully extended position. In this way, the paving machine screed assembly 10 may be readily adjusted from a minimum paving width up to a maximum paving width that is double the minimum width. According to specific design needs, selected ones of the disclosed embodiments of the present invention facilitate preventing rotational and/or linear movement between the first and second coupling members 46, 50.

Although the invention has been described with reference to various preferred embodiments, in light of the overall disclosure one skilled in the relevant arts may recognize or conceive modifications, variations, and alternative constructions not specifically addressed in detail above. For example, although several structures sufficient to enhance the rigidity of a screed assembly 10 and to prevent rotational and/or linear movement between the coupling members 46, 50 have been described, one skilled in the mechanical arts may well find other structures sufficient for this purpose. Such adaptations, and all other aspects, objects, and advantages of this invention as may be obtained from a study of the drawings, the disclosure, and the appended claims, are intended to be covered by the appended claims.

The invention claimed is:

1. A screed assembly for a paving machine, comprising:

an elongate main screed portion having a fixed length frame;

an elongate extension screed portion longitudinally axially extendible from said main screed portion, said extension screed portion having a variable length frame defined by an inner end wall and an outer end wall and having an intermediate wall, said inner end wall and said intermediate wall being axially moveable one relative to the other;

a coupling portion located between said variable length frame inner and outer end walls, said coupling portion having a first coupling member connected to said inner end wall and extending through said intermediate wall toward said outer end wall and a second coupling member connected to said outer end wall and extending to said intermediate wall, said first and second coupling members being coaxially slidable one within the other; and an actuator having a first end portion connected to said main screed portion frame and a second end portion connected to said extension screed portion variable length frame outer end wall, said actuator being adapted to controllably move said extension screed portion variable length frame longitudinally axially relative to said main screed portion fixed length frame between a fully retracted position at which said variable length portion intermediate wall is urged toward said inner end wall and a fully extended position at which said variable length portion intermediate wall is urged away from said inner end wall.

2. A screed assembly for a paving machine, as set forth in claim 1, wherein said first and second coupling members are coaxially positioned cylinders, one slidable within the other.

3. A screed assembly for a paving machine, as set forth in claim 1, wherein one of said coupling members includes at least one bushing extending circumferentially over a linear portion of said one coupling member, said bushing being adapted to provide a clearance fit between said coaxially slidable coupling members.

4. A screed assembly for a paving machine, as set forth in claim 1, wherein said coupling members respectively include a key and keyway positioned to permit relative linear movement between said coupling members and to inhibit relative rotational movement between said coupling members.

5. A screed assembly for a paving machine, as set forth in claim 4, wherein said key and keyway each have at least one tapered mating wall.

6. A screed assembly for a paving machine, as set forth in claim 4, wherein said key is at least one of power driven into and power released from said keyway.

7. A screed assembly for a paving machine, as set forth in claim 6, wherein said key is controllably driven into and released from said keyway by a hydraulic actuator.

8. A screed assembly for a paving machine, as set forth in claim 6, wherein said key is driven into said keyway by a spring biased actuator.

9. A screed assembly for a paving machine, as set forth in claim 6, wherein said key is controllably released from said keyway by an electrical actuator.

10. A screed assembly for a paving machine, as set forth in claim 2, wherein one of said coaxial cylinders includes a chuck adapted to controllably clamp the other of said coaxial cylinders in a manner sufficient to prevent relative movement between said cylinders.

11. A screed assembly for a paving machine, as set forth in claim 10, wherein said chuck is one of electrically and hydraulically actuated.

12. A screed assembly for a paving machine, as set forth in claim 1, wherein one of said first and second coupling members includes at least one power deployed protrusion and the other of said first and second coupling members includes at least one respective receptacle positioned to mate with said at least one protrusion when deployed.

13. A screed assembly for a paving machine, as set forth in claim 1, wherein said first and second coupling members cooperate to form an elongate cavity and wherein said actuator is a linear operator having an elongate body at least partially located within and axially aligned with said elongate cavity.

14. A method for providing a screed assembly for a paving machine, said screed assembly having an elongate main screed portion having a fixed length frame and an elongate extension screed portion longitudinally axially extendible from said main screed portion, said extension screed portion having a variable length frame defined by an inner end wall and an outer end wall and having an intermediate wall, said inner end wall and said intermediate wall being axially moveable one relative to the other; a coupling portion located between said variable length frame inner and outer end walls, said coupling portion having a first coupling member connected to said inner end wall and extending through said intermediate wall toward said outer end wall and a second coupling member connected to said outer end wall and extending to said intermediate wall, said first and second coupling members being coaxially slidable one within the other; and an actuator having a first end portion connected to said main screed portion frame and a second end portion connected to said extension screed portion variable length frame outer end wall, said actuator being adapted to controllably move said extension screed portion variable length frame longitudinally axially relative to said main screed portion fixed length frame between a fully retracted position and a fully extended position, comprising the steps of:

moving said variable length portion intermediate wall toward said, inner end wall in response to said actuator moving said extension screed portion variable length frame longitudinally axially relative to said main screed portion fixed length frame to said fully retracted position, and moving said variable length portion intermediate wall away from said inner end wall in response to said actuator moving said extension screed portion variable length frame longitudinally axially relative to said main screed portion fixed length frame to said fully extended position.

15. A method for providing an extendible screed assembly for a paving machine, as set forth in claim 14, including the step of inhibiting relative rotational movement between said coupling members.

16. A screed assembly for a paving machine, comprising:

an elongate main screed portion having a fixed length frame;

an elongate extension screed portion longitudinally axially extendible from said main screed portion, said extension screed portion having a variable length frame defined by an inner end wall and an outer end wall and having an intermediate wall, said inner end wall and said intermediate wall being axially moveable one relative to the other;

a coupling portion located between said variable length frame inner and outer end walls, said coupling portion having a first cylindrical coupling member connected to said inner end wall and extending through said intermediate wall toward said outer end wall and a second cylindrical coupling member connected to said outer end wall and extending to said intermediate wall, said first and second cylindrical coupling members being coaxially slidable one within the other;

an actuator having a first end portion connected to said main screed portion frame and a second end portion connected to said extension screed portion variable length frame outer end wall, said actuator being adapted to controllably move said extension screed portion variable length frame longitudinally axially relative to said main screed portion fixed length frame between a fully retracted position at which said variable length portion intermediate wall is urged toward said inner end wall and a fully extended position at which said variable length portion intermediate wall is urged away from said inner end wall, and wherein said cylindrical coupling members respectively include a key and keyway positioned to permit relative linear movement between said coupling members and to inhibit relative rotational movement between said coupling members.

17. A screed assembly for a paving machine, as set forth in claim 16, wherein said key and keyway each have at least one tapered mating wall.

* * * * *

UNITED STATES PATENT AND TRADEMARK OFFICE

CERTIFICATE OF CORRECTION

PATENT NO. : 7,287,931 B2
APPLICATION NO. : 11/058830
DATED : October 30, 2007
INVENTOR(S) : Anibaldi et al.

It is certified that error appears in the above-identified patent and that said Letters Patent is hereby corrected as shown below:

In Column 1, Line 4, delete "2005" and insert -- 2004 --, therefor.

Signed and Sealed this

Twenty-fourth Day of June, 2008

JON W. DUDAS
*Director of the United States Patent and Trademark Office*